US011927371B2

(12) United States Patent
Ma

(10) Patent No.: US 11,927,371 B2
(45) Date of Patent: Mar. 12, 2024

(54) TWO STAGE SINGLE GAS COOLER HVAC CYCLE

(71) Applicant: Carrier Corporation, Palm Beach Gardens, FL (US)

(72) Inventor: Zidu Ma, Palm Beach Gardens, FL (US)

(73) Assignee: Carrier Corporation, Palm Beach Gardens, FL (US)

( * ) Notice: Subject to any disclaimer, the term of this patent is extended or adjusted under 35 U.S.C. 154(b) by 625 days.

(21) Appl. No.: 17/254,523

(22) PCT Filed: May 15, 2020

(86) PCT No.: PCT/US2020/033118
§ 371 (c)(1),
(2) Date: Dec. 21, 2020

(87) PCT Pub. No.: WO2020/251723
PCT Pub. Date: Dec. 17, 2020

(65) Prior Publication Data

US 2021/0270498 A1 Sep. 2, 2021

Related U.S. Application Data

(60) Provisional application No. 62/860,445, filed on Jun. 12, 2019.

(51) Int. Cl.
*F25B 1/10* (2006.01)
*F25B 9/00* (2006.01)
(Continued)

(52) U.S. Cl.
CPC ..... *F25B 1/10* (2013.01); *F25B 9/008* (2013.01); *F25B 40/02* (2013.01); *F25B 49/02* (2013.01);
(Continued)

(58) Field of Classification Search
CPC ..... F25B 9/008; F25B 2309/061; F25B 1/10; F25B 2700/21152; F25B 2700/21163; F25B 2700/21175
See application file for complete search history.

(56) References Cited

U.S. PATENT DOCUMENTS 8,671,703 B2 * 3/2014 Mitra ..... F25B 1/10 62/509
8,997,518 B2 * 4/2015 Jang ..... F04C 23/008 62/513
(Continued)

FOREIGN PATENT DOCUMENTS

CN 1840986 A 10/2006
CN 101688696 A 3/2010
(Continued)

OTHER PUBLICATIONS

International Search Report and Written Opinion for International Patent Application No. PCT/US2020/033118 dated Jul. 10, 2020.
(Continued)

*Primary Examiner* — Lionel Nouketcha
(74) *Attorney, Agent, or Firm* — Carlson, Gaskey & Olds, P.C.

(57) ABSTRACT

A coolant cycle system for cooling a structure includes a two stage compressor configured to compress a coolant. The two stage compressor has a first stage with a first stage inlet and a first stage outlet and a second stage with a second stage inlet and a second stage outlet. The second stage is a high pressure stage relative to the first stage. A gas cooler has a coolant inlet fluidly connected to the second stage outlet and has a gas cooler outlet. The gas cooler outlet is fluidly connected to a heat exchanger and a fluid storage tank. The heat exchanger is configured to cool the fluid storage tank and has a heat exchanger coolant outlet fluidly connected to the second stage inlet. The fluid storage tank has a fluid
(Continued)

storage tank outlet fluidly connected to a coolant inlet of an evaporator. A coolant outlet of the evaporator is fluidly connected to the first stage inlet of the compressor. The first stage outlet of the compressor is fluidly connected to the second stage inlet.

20 Claims, 2 Drawing Sheets

(51) Int. Cl.
*F25B 40/02* (2006.01)
*F25B 49/02* (2006.01)

(52) U.S. Cl.
CPC ... *F25B 2309/061* (2013.01); *F25B 2400/053* (2013.01); *F25B 2400/121* (2013.01); *F25B 2400/13* (2013.01); *F25B 2400/16* (2013.01); *F25B 2500/18* (2013.01); *F25B 2600/25* (2013.01); *F25B 2700/2102* (2013.01); *F25B 2700/21152* (2013.01); *F25B 2700/21163* (2013.01); *F25B 2700/21175* (2013.01)

(56) References Cited

U.S. PATENT DOCUMENTS

| | | | | |
|---|---|---|---|---|
| 2005/0044865 | A1 | 3/2005 | Manole | |
| 2014/0174703 | A1* | 6/2014 | Yoshioka | F28F 9/0243 165/173 |
| 2018/0023584 | A1* | 1/2018 | Morgan | F16C 17/026 62/498 |
| 2018/0231006 | A1* | 8/2018 | Sun | F04D 25/06 |

FOREIGN PATENT DOCUMENTS

| | | | |
|---|---|---|---|
| CN | 101688698 | A | 3/2010 |
| CN | 101688725 | A | 3/2010 |
| JP | 2001004235 | A | 1/2001 |
| JP | 2005214442 | A | 8/2005 |
| WO | 2008140454 | | 11/2008 |
| WO | 2009005366 | | 1/2009 |

OTHER PUBLICATIONS

International Preliminary Report on Patentability for International Patent Application No. PCT/US2020/033118 dated Dec. 14, 2021.

* cited by examiner

TWO STAGE SINGLE GAS COOLER HVAC CYCLE

CROSS-REFERENCE TO RELATED APPLICATION

This application claims priority to U.S. Provisional Patent Application No. 62/860445 filed Jun. 12, 2019.

TECHNICAL FIELD

The present disclosure relates generally to heating, ventilation, air conditioning, and refrigeration (HVAC&R) cycles, and more specifically to two stage compression economized cycles including an integrated heat exchanger and refrigerant storage volume.

BACKGROUND

Typical two stage refrigeration systems utilizes an economizer heat exchanger or a flash tank to achieve efficient cooling performance and maintain desired discharge pressure and temperature for operations at high ambient temperatures. Incorporating the economizer heat exchanger or the flash tank into a system design often results in relatively complex and more expensive systems. For applications such as supermarket, the refrigeration systems usually involve multiple compressors and heat exchangers, and incorporating economizer or flash tank designs becomes normal practice. In contrast, for small standing alone applications, the system complexity and cost are particularly notable.

Reducing the complexity and the cost of typical intercooled refrigeration system designs is desirable for high efficiency small scale refrigeration implementations such as mobile refrigeration systems, ice cream machines, and the like.

SUMMARY OF THE INVENTION

In one exemplary embodiment a coolant cycle system for cooling a structure includes a two stage compressor configured to compress a coolant and having a first stage with a first stage inlet and a first stage outlet and a second stage with a second stage inlet and a second stage outlet, wherein the second stage is a high pressure stage relative to the first stage, a gas cooler having a coolant inlet fluidly connected to the second stage outlet and having a gas cooler outlet, the gas cooler outlet being fluidly connected to a heat exchanger and a fluid storage tank, the heat exchanger being configured to cool the fluid storage tank and having a heat exchanger coolant outlet fluidly connected to the second stage inlet, the fluid storage tank having a fluid storage tank outlet fluidly connected to a coolant inlet of an evaporator, a coolant outlet of the evaporator being fluidly connected to the first stage inlet of the compressor, and wherein the first stage outlet of the compressor is fluidly connected to the second stage inlet.

In another example of the above described coolant cycle system for cooling a structure the coolant cycle is a transcritical coolant cycle.

In another example of any of the above described coolant cycle systems for cooling a structure the coolant is a non-synthetic coolant.

In another example of any of the above described coolant cycle systems for cooling a structure the non-synthetic coolant is one of R-744 ($CO_2$), R-290 (propane), R32 (difluoromethane), R1234ze(E) (trans-1,3,3,3-Tetrafluoropropene), R454B/R454A (a mixture of difluoromethane and 2,3,3,3-Tetrafluoropropene), R1234yf (2,3,3,3-Tetrafluoropropene), or any combination of the foregoing.

In another example of any of the above described coolant cycle systems for cooling a structure the non-synthetic coolant is $CO_2$.

Another example of any of the above described coolant cycle systems for cooling a structure further includes a first controllable valve upstream of a heat exchanger inlet and configured to control a flow of coolant into the heat exchanger.

Another example of any of the above described coolant cycle systems for cooling a structure further includes a first sensor including at least one of a temperature sensor and a pressure sensor downstream of the heat exchanger outlet, and wherein a controller is configured to control the first controllable valve based at least in part on a sensor output of the first sensor.

In another example of any of the above described coolant cycle systems for cooling a structure the first sensor is upstream of a coolant merge point, and the coolant merge point is a merger of coolant from the heat exchanger outlet and the first stage outlet.

In another example of any of the above described coolant cycle systems for cooling a structure the first sensor is downstream of a coolant merge point, and the coolant merge point is a merger of coolant from the heat exchanger outlet and the first stage outlet.

Another example of any of the above described coolant cycle systems for cooling a structure further includes a second controllable valve disposed between the fluid storage tank outlet and the coolant inlet of the evaporator.

Another example of any of the above described coolant cycle systems for cooling a structure further includes a second sensor disposed downstream of the coolant outlet of the evaporator, and wherein a controller is configured to control the second controllable valve based on an output of the second sensor.

In another example of any of the above described coolant cycle systems for cooling a structure the second sensor is at least one of a temperature sensor and a pressure sensor.

In another example of any of the above described coolant cycle systems for cooling a structure the coolant cycle is characterized by a lack of an intercooler heat exchanger.

In another example of any of the above described coolant cycle systems for cooling a structure the heat exchanger comprises a heat exchanger tube disposed about the fluid storage tank.

In another example of any of the above described coolant cycle systems for cooling a structure an inlet of the heat exchanger is disposed proximate the outlet of the fluid storage tank.

In another example of any of the above described coolant cycle systems for cooling a structure an outlet of the heat exchanger is disposed proximate an inlet of the fluid storage tank.

In another example of any of the above described coolant cycle systems for cooling a structure the two stage compressor is a single compressor having two stages.

In another example of any of the above described coolant cycle systems for cooling a structure the two stage compressor is a pair of distinct compressors, and wherein the compressors are mechanically linked via a drive shaft.

These and other features of the present invention can be best understood from the following specification and drawings, the following of which is a brief description.

DETAILED DESCRIPTION

Figure 1:
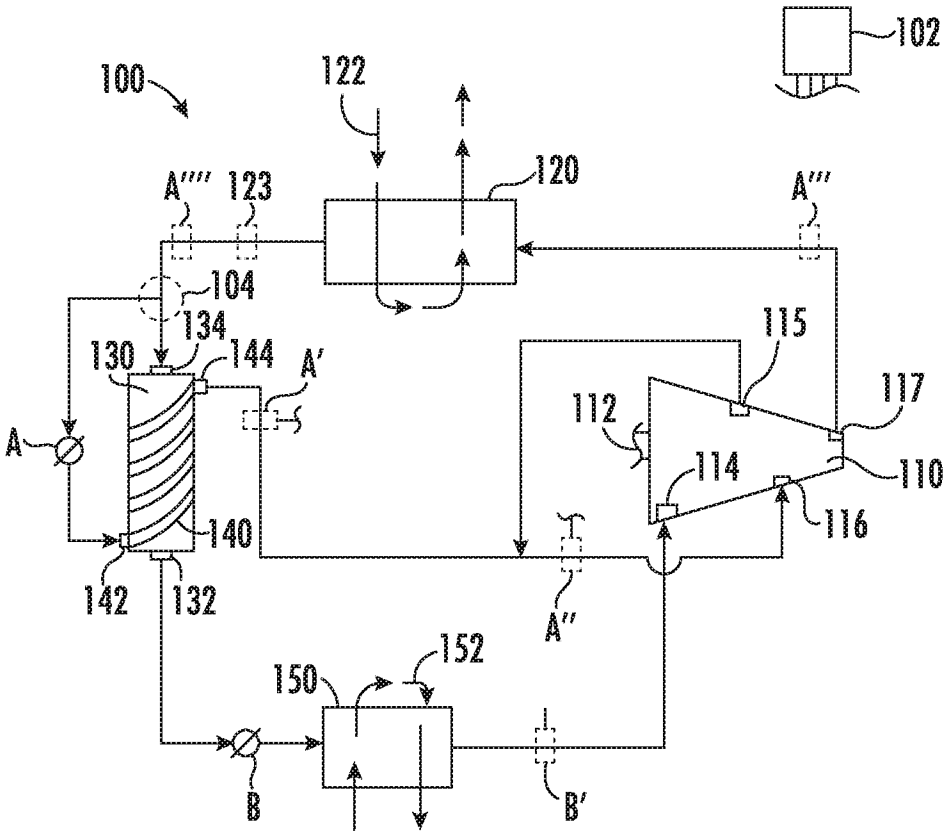
FIG. 1 illustrates an exemplary two stage trans-critical refrigeration system.

FIG. 1 schematically illustrates an exemplary two stage cooling system 100 without an air cooled intercooler. The cooling system 100 is configured to operate a coolant cycle using a refrigerant. The refrigerant can be any suitable refrigerant, for example the refrigerant can include R-744 ($CO_2$), R-290 (propane), R32 (difluoromethane), R1234ze (E) (trans-1,3,3,3-Tetrafluoropropene), R454B/R454A (a mixture of difluoromethane and 2,3,3,3-Tetrafluoropropene), R1234yf (2,3,3,3-Tetrafluoropropene), or the like, or any combination of the foregoing. The refrigerant can be a low global warming potential (GWP) refrigerant, such as having a GWP value of less than or equal to 3000, or less than or equal to 2000, or less than or equal to 1000, or a GWP of 1 (e.g., in the case of $CO_2$ refrigerant). The refrigerant can be classified as an A1 (refrigerants with no toxicity at concentrations less than or equal to 400 ppm and no flame propagation when tested in air at 21 degrees C. and 101 kPa), A2 (refrigerants with no toxicity at concentrations less than or equal to 400 ppm and having a lower flammability limit of more than 0.10 kg/m$^3$ at 21 degrees C. and 101 kPA and a heat combustion of less than 19 kJ/kg), or A3 (refrigerants with no toxicity at concentrations less than or equal to 400 ppm and having a lower flammability limit of less than or equal to than 0.10 kg/m$^3$ at 21 degrees C. and 101 kPA and a heat combustion of greater than or equal to 19 kJ/kg), or any similar classification, for example classifications defined by the latest revision of ASHRAE Standard 34 at the time of filing of the present disclosure. When carbon dioxide, and some other non-synthetic coolant are used as the refrigerant, a trans-critical cycle is employed, often requiring two gas coolers instead of condensers at the discharge outlet of each stage due to supercritical conditions. As used herein a non-synthetic coolant is any coolant naturally exists and/or obtained from certain way of processing naturally existed substances. Alternative coolants can include any other non-synthetic coolant having a low global warming potential (GWP). By way of examples, such coolants can include ammonia and petroleum based hydrocarbons. The trans-critical cycle is a thermodynamic cycle in which the coolant goes through both a subcritical state and a supercritical state as the coolant passes through the cycle, in which a gas cooler, instead of a condenser, is used.

Figure 2:
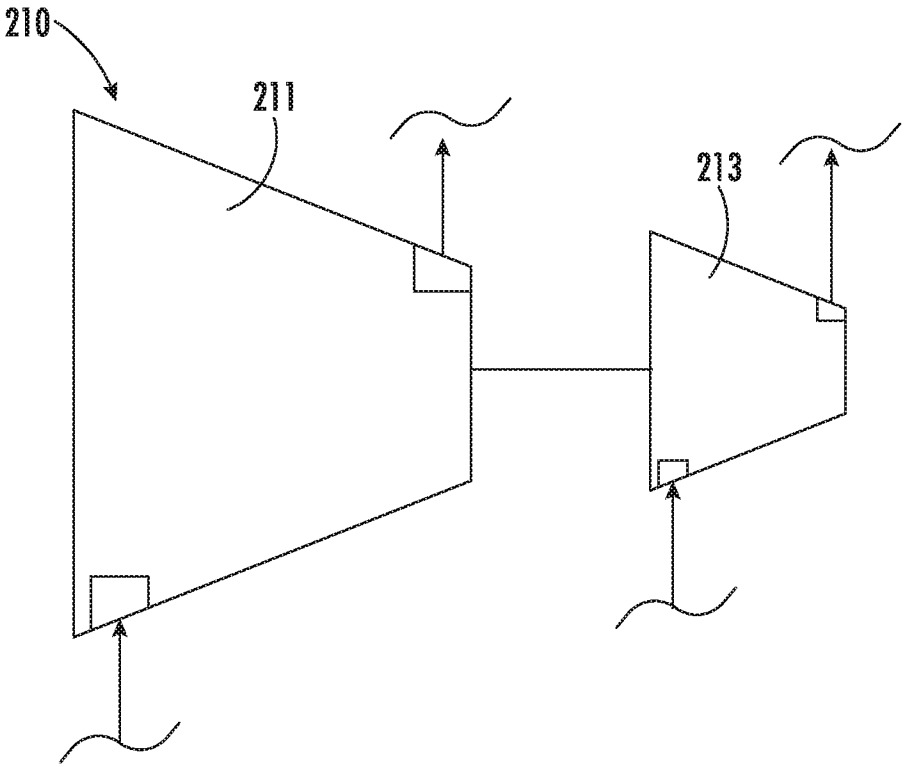
FIG. 2 schematically illustrates an alternate exemplary compressor configuration for the refrigeration system of claim 1.

Included within the cooling system 100 is a two stage compressor 110. The two stage compressor 110 can include a mechanical input 112 or an electrical input which drives rotation of the compressor 110 according to any known compressor drive configuration. A first stage of the compressor 110 includes a first input 114 and a first output 115, while a second stage of the compressor 110 includes a second input 116 and a second output 117. In the illustrated example of FIG. 1, the compressor 110 is a single two stage compressor. In an alternative example illustrated in FIG. 2, the two stage compressor 210 can be configured of two linked individual compressors 211, 213 with each of the linked compressors 211, 213 corresponding to one of the stages of the exemplary compressor 110 of FIG. 1, or two independent compressors. Operations of the compressor 110, 210 are controlled via a controller 102 via any compressor control scheme. The controller 102 can be a dedicated controller, and can be connected to the compressor 110, 210 via any communication or control scheme such as hard wiring or wireless communications.

The first stage of the compressor 110 is a low pressure stage that compresses the coolant vapor to a first pressure at the first outlet 115. The second stage of the compressor 110 is a high pressure stage, relative to the first stage, and compresses the coolant vapor to a higher pressure. In some examples, the pressure at the second inlet 116 is higher than the pressure at the first outlet 115, but lower than the pressure at the first inlet 114, which could happen if two independent compressors were to be used. In other examples, the pressure at the first outlet 115 is approximately the same as the pressure at the second inlet 116, which is the normally operated condition.

The second outlet 117 is a high pressure output and is fluidly connected to a gas cooler 120. As the pressurized coolant passes through the gas cooler 120, a stream of outdoor air 122 cools the compressed gas. In one example the gas cooler 120 is air based. In an alternative example, the gas cooler can be a water based gas cooler and the coolant is cooled via a stream of cold liquid. The cooled compressed coolant is then passed to split 104 where a portion of the cooled compressed coolant is passed to a fluid storage tank 130, and a remainder of the cooled compressed coolant is passed to a heat exchanger tube 140. The heat exchanger tube 140 surrounds the fluid storage tank 130, and functions to cool the fluid storage tank 130.

In the illustrated example of FIG. 1, an input 142 to the heat exchanger tube 140 is positioned proximate to an output 132 of the fluid tank 130, and an output of the heat exchanger tube 140 is positioned proximate to an input 134 of the fluid storage tank 130. Positioning the inputs and outputs in this manner allows better efficiency in heat exchanging between the two coolant streams, at the same time, allows an intercooling function by mixing the cool coolant from outlet 144 with hot coolant from outlet 115 using the excess fluid flow from the gas cooler 120 to control and maintain low discharge temperatures from the fluid storage tank 130 prior to providing the coolant to an evaporator 150.

The output 132 of the fluid storage tank 130 is connected to the evaporator 150. The evaporator 150 receives internal air 152 of the structure being cooled, and cools the air 152 before returning the cooled air 152 to the structure. The cooled air then cools the internal compartments of the structure. The evaporator 150 imparts a pressure loss on the coolant, and the coolant output of the evaporator 150 is connected to the first input 114 of the compressor 110 where it is re-compressed, and the coolant cycle re-starts. As all coolant continuously circulates, and coolant does not leave or enter the coolant circuit during standard operations, the circuit is referred to as a closed loop circuit.

Due to the structure of the heat exchange tube 140, minimal pressure loss is imparted on the coolant, and the outlet 144 of the heat exchanger tube 140 is connected to the second inlet 116 of the compressor 110, and is compressed in the second stage of the compressor 110. In addition, the first output 115 of the compressor 110 is looped back and merged with the coolant flow from the output 144 of the heat exchange tube 140, prior to connecting the flow to the second inlet 116 to achieve an intercooling function.

In order to control fluid flow between the fluid storage tank 130 and the fluid heat exchanger tube 140 through the joint 104, a controllable valve A is positioned between the joint 104 and the inlet 142 of the fluid heat exchange tube 140. A temperature sensor A' or A" is positioned downstream of the outlet 144 of the fluid heat exchange tube 140 and communicates with the controller 102. The controllable valve A is then controlled by the controller 102 based on the temperature at the temperature sensor A', A", A"', A"" using a feedback control loop to ensure that a sufficient temperature is maintained through the fluid heat exchange tube 140.

In addition, flow of coolant from the fluid storage tank 130 into the evaporator 150 is controlled via a second controllable valve B. A second temperature sensor B' is positioned downstream of the evaporator 150, and allows for control of the fluid flow through the evaporator 150 based on the output temperature of the coolant.

In alternative examples, flow of the coolant can be controlled based on pressure or a combination of temperature and pressure. In such examples, each of the sensors A', A", A"', A"", B' can be a pressure sensor or a combination of a pressure sensor and a temperature sensor depending on the type of control being utilized for the corresponding valve A, B.

In some examples, an additional valve 123 can be included between the outlet of the gas cooler 120 and the joint 104. The valve 123 can help maintain a pressure at the joint 104, and is controlled by the controller 102 according to known valve control systems.

By utilizing the system 100 illustrated in FIG. 1 an intercooler heat exchanger and a flash tank can be omitted from the system 100 entirely, thereby simplifying the coolant flow and the structure and reducing costs and size of the system 100.

It is further understood that any of the above described concepts can be used alone or in combination with any or all of the other above described concepts. Although an embodiment of this invention has been disclosed, a worker of ordinary skill in this art would recognize that certain modifications would come within the scope of this invention. For that reason, the following claims should be studied to determine the true scope and content of this invention.

The invention claimed is:

1. A coolant cycle system for cooling a structure comprising:

a two stage compressor configured to compress a coolant and having a first stage with a first stage inlet and a first stage outlet and a second stage with a second stage inlet and a second stage outlet, wherein the second stage is a high pressure stage relative to the first stage;

a gas cooler having a coolant inlet fluidly connected to the second stage outlet and having a gas cooler outlet;

the gas cooler outlet being fluidly connected to a heat exchanger and a fluid storage tank via a split that is upstream of the heat exchanger and the fluid storage tank, the heat exchanger being configured to cool the fluid storage tank and having a heat exchanger coolant outlet fluidly connected to the second stage inlet, wherein the split comprises a first fluid connection path to pass a portion of cooled compressed coolant exiting the gas cooler outlet to a fluid storage tank inlet and a second fluid connection path to pass a remainder of the cooled compressed coolant exiting the gas cooler outlet to a heat exchanger inlet;

the fluid storage tank having a fluid storage tank outlet fluidly connected to a coolant inlet of an evaporator;

a coolant outlet of the evaporator being fluidly connected to the first stage inlet of the two stage compressor; and wherein the first stage outlet of the two stage compressor is fluidly connected to the second stage inlet.

2. The coolant cycle system of claim 1, wherein the coolant cycle is a transcritical coolant cycle.

3. The coolant cycle system of claim 1, wherein the coolant is a non-synthetic coolant.

4. The coolant cycle system of claim 3, wherein the non-synthetic coolant is one of R-744 ($CO_2$), R-290 (propane), R32 (difluoromethane), R1234ze(E) (trans-1,3,3,3-Tetrafluoropropene), R454B/R454A (a mixture of difluoromethane and 2,3,3,3-Tetrafluoropropene), R1234yf (2,3,3,3-Tetrafluoropropene), or any combination of the foregoing.

5. The coolant cycle system of claim 4, wherein the non-synthetic coolant is $CO_2$.

6. The coolant cycle system of claim 1, further comprising a first controllable valve upstream of the heat exchanger inlet and configured to control a flow of coolant into the heat exchanger.

7. The coolant cycle system of claim 6, further comprising a first sensor including at least one of a temperature sensor and a pressure sensor downstream of the heat exchanger coolant outlet, and wherein a controller is configured to control the first controllable valve based at least in part on a sensor output of the first sensor.

8. The coolant cycle system of claim 7, wherein the first sensor is upstream of a coolant merge point, and the coolant merge point is a merger of coolant from the heat exchanger coolant outlet and the first stage outlet.

9. The coolant cycle system of claim 7, wherein the first sensor is downstream of a coolant merge point, and the coolant merge point is a merger of coolant from the heat exchanger coolant outlet and the first stage outlet.

10. The coolant cycle system of claim 7, further comprising a second controllable valve disposed between the fluid storage tank outlet and the coolant inlet of the evaporator.

11. The coolant cycle system of claim 10, further comprising a second sensor disposed downstream of the coolant outlet of the evaporator, and wherein a controller is configured to control the second controllable valve based on an output of the second sensor.

12. The coolant cycle system of claim 11, wherein the second sensor is at least one of a temperature sensor and a pressure sensor.

13. The coolant cycle system of claim 1, wherein the coolant cycle is characterized by a lack of an intercooler heat exchanger.

14. The coolant cycle system of claim 1, wherein the two stage compressor is a single compressor having two stages.

15. The coolant cycle system of claim 1, wherein the two stage compressor is a pair of distinct compressors, and wherein the pair of distinct compressors are mechanically linked via a drive shaft.

16. The coolant cycle system of claim 1, wherein the heat exchanger comprises a heat exchanger tube that surrounds the fluid storage tank.

17. The coolant cycle system of claim 16, wherein the fluid storage tank inlet is at an inlet end of the fluid storage tank, and the fluid storage tank outlet is at an outlet end of the fluid storage tank, and wherein the heat exchanger inlet is disposed proximate the fluid storage tank outlet at the outlet end of the fluid storage tank, and wherein the heat exchanger coolant outlet is disposed proximate the fluid storage tank inlet at the inlet end of the fluid storage tank.

18. A coolant cycle system for cooling a structure comprising:

a two stage compressor configured to compress a coolant and having a first stage with a first stage inlet and a first stage outlet and a second stage with a second stage inlet and a second stage outlet. wherein the second stage is a high pressure stage relative to the first stage:

a gas cooler having a coolant inlet fluidly connected to the second stage outlet and having a gas cooler outlet:

the gas cooler outlet being fluidly connected to a heat exchanger and a fluid storage tank, the heat exchanger being configured to cool the fluid storage tank and having a heat exchanger coolant outlet fluidly connected to the second stage inlet, wherein the heat exchanger comprises a heat exchanger tube that surrounds the fluid storage tank;

the fluid storage tank having a fluid storage tank outlet fluidly connected to a coolant inlet of an evaporator:

a coolant outlet of the evaporator being fluidly connected to the first stage inlet of the two stage compressor: and wherein the first stage outlet of the two stage compressor is fluidly connected to the second stage inlet.

19. The coolant cycle system of claim 18, wherein an inlet of the heat exchanger is disposed proximate the fluid storage tank outlet.

20. The coolant cycle system of claim 18, wherein the heat exchanger coolant outlet is disposed proximate an inlet of the fluid storage tank.

* * * * *